US009017014B2

(12) United States Patent
Lee et al.

(10) Patent No.: US 9,017,014 B2
(45) Date of Patent: Apr. 28, 2015

(54) AFT OUTER RIM SEAL ARRANGEMENT

(71) Applicants: Ching-Pang Lee, Cincinnati, OH (US); Kok-Mun Tham, Oviedo, FL (US); Eric Schroeder, Loveland, OH (US); Jamie Meeroff, Cincinnati, OH (US); Samuel R. Miller, Jr., Port St. Lucie, FL (US); John J. Marra, Winter Springs, FL (US); Christian X. Campbell, Charlotte, NC (US)

(72) Inventors: Ching-Pang Lee, Cincinnati, OH (US); Kok-Mun Tham, Oviedo, FL (US); Eric Schroeder, Loveland, OH (US); Jamie Meeroff, Cincinnati, OH (US); Samuel R. Miller, Jr., Port St. Lucie, FL (US); John J. Marra, Winter Springs, FL (US); Christian X. Campbell, Charlotte, NC (US)

(73) Assignee: Siemens Energy, Inc., Orlando, FL (US)

( * ) Notice: Subject to any disclaimer, the term of this patent is extended or adjusted under 35 U.S.C. 154(b) by 0 days.

(21) Appl. No.: 13/930,482

(22) Filed: Jun. 28, 2013

(65) Prior Publication Data

US 2015/0003973 A1 Jan. 1, 2015

(51) Int. Cl.

| | |
|---|---|
| ***F01D 11/08*** | (2006.01) |
| ***F01D 25/12*** | (2006.01) |
| ***F01D 11/02*** | (2006.01) |
| ***F01D 5/18*** | (2006.01) |

(52) U.S. Cl.

CPC . *F01D 11/02* (2013.01); *F01D 5/18* (2013.01)

(58) Field of Classification Search

CPC ..... F01D 5/187; F01D 11/001; F01D 11/02; F01D 11/04; F01D 11/005; F04D 29/083; F04D 29/164

USPC ..... 415/115, 116, 168.1, 168.2, 168.4, 175, 415/176, 173.7

See application file for complete search history.

(56) References Cited

U.S. PATENT DOCUMENTS

| | | | | |
|---|---|---|---|---|
| 3,497,225 | A | 2/1970 | Workman | |
| 3,647,311 | A | 3/1972 | Wootton et al. | |
| 4,348,157 | A * | 9/1982 | Campbell et al. | 416/95 |
| 4,682,933 | A | 7/1987 | Wagner | |
| 4,927,327 | A | 5/1990 | Keller | |
| 5,135,354 | A * | 8/1992 | Novotny | 415/115 |
| 6,077,034 | A * | 6/2000 | Tomita et al. | 415/110 |
| 6,276,692 | B1 | 8/2001 | Beeck et al. | |
| 6,331,097 | B1 * | 12/2001 | Jendrix | 416/96 R |
| 6,481,959 | B1 | 11/2002 | Morris et al. | |
| 6,960,060 | B2 * | 11/2005 | Lee | 415/115 |
| 7,238,001 | B2 | 7/2007 | Rushton | |
| 7,238,008 | B2 * | 7/2007 | Bobo et al. | 416/220 R |
| 7,244,104 | B2 * | 7/2007 | Girgis et al. | 416/193 A |
| 7,465,152 | B2 | 12/2008 | Nigmatulin | |
| 7,578,653 | B2 | 8/2009 | Klasing et al. | |
| 7,743,613 | B2 * | 6/2010 | Lee et al. | 60/782 |
| 2008/0112791 | A1 * | 5/2008 | Lee et al. | 415/58.4 |
| 2008/0112795 | A1 * | 5/2008 | Lee et al. | 415/115 |
| 2010/0008760 | A1 * | 1/2010 | Morris et al. | 415/115 |
| 2010/0183426 | A1 * | 7/2010 | Liang | 415/110 |
| 2011/0002777 | A1 | 1/2011 | Smith | |
| 2011/0027103 | A1 * | 2/2011 | Philippot | 416/97 R |
| 2011/0067414 | A1 | 3/2011 | Matwey et al. | |
| 2012/0003084 | A1 | 1/2012 | Matwey et al. | |
| 2012/0163955 | A1 * | 6/2012 | Devi et al. | 415/1 |

* cited by examiner

*Primary Examiner* — Dwayne J White
*Assistant Examiner* — Su Htay

(57) ABSTRACT

An outer rim seal arrangement (10), including: an annular rim (70) centered about a longitudinal axis (30) of a rotor disc (31), extending fore and having a fore-end (72), an outward-facing surface (74), and an inward-facing surface (76); a lower angel wing (62) extending aft from a base of a turbine blade (22) and having an aft end (64) disposed radially inward of the rim inward-facing surface to define a lower angel wing seal gap (80); an upper angel wing (66) extending aft from the turbine blade base and having an aft end (68) disposed radially outward of the rim outward-facing surface to define a upper angel wing seal gap (80, 82); and guide vanes (100) disposed on the rim inward-facing surface in the lower angel wing seal gap. Pumping fins (102) may be disposed on the upper angel wing seal aft end in the upper angel wing seal gap.

20 Claims, 3 Drawing Sheets

AFT OUTER RIM SEAL ARRANGEMENT

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The present invention relates to an aft outer rim seal arrangement for a turbine blade in a gas turbine engine. In particular, the invention relates to flow guiding elements incorporated as part of the aft outer rim seal arrangement.

BACKGROUND OF THE INVENTION

Gas turbine engine blades used in the engine's turbine section are typically cooled via internal cooling channels through which compressed air is forced. This compressed air is typically drawn from a supply of compressed air created by the engine's compressor. However, drawing of the compressed air for cooling reduces the amount of compressed air available for combustion. This, in turn, lowers engine efficiency. Consequently, minimizing the amount of cooling air withdrawn from the compressor for cooling is an important technology in modern gas turbine design.

In some gas turbine engine models downstream blades extend relatively far in the radial direction. Downstream blades may include, for example, a last row of blades. Cooling channels typically direct cooling air from a base of the blade toward a tip, where it is exhausted into a flow of combustion gases. By virtue of the cooling channel extending within the blade so far radially outward, rotation of the blade, and the cooling channel disposed therein, imparts a centrifugal force on the cooling air that urges the cooling air in the cooling channel radially outward. The cooling air exits the blade and this creates a flow of cooling air within the cooling channel. This flow within the cooling channel creates a suction that draws more cooling air from a rotor cavity around the base of the blade into the cooling channel. Consequently, unlike convention cooling where compressed air is forced through the cooling channels, air that is not compressed, such as ambient air present outside of the gas turbine engine, can be used to cool the downstream blades.

A static pressure of ambient air is sufficiently greater than a static pressure in the rotor cavity to produce a flow of cooling fluid from a source of ambient air toward the rotor cavity. Thus, a static pressure of ambient air may push a supply of ambient air toward the rotor cavity, where a suction generated by the rotation of the blades then draws the ambient air from the rotor cavity through the cooling channels in the turbine blades, thereby completing an ambient air cooling circuit. The suction force aids in drawing ambient air into the rotor cavity. In this manner a flow of ambient air throughout the cooling circuit can be maintained.

However, a static pressure of ambient air within the rotor cavity is not substantially greater than a static pressure of combustion gases in a radially inward region of the hot gas path. The static pressure of the combustion gases in a radially inward region of the hot gas path may vary circumferentially and there may be transient operating conditions that produce static pressure differences in the combustion gases. These conditions may lead to ingestion of hot gases through a rim seal separating the rotor cavity from the hot gases in the radially inward region of the hot gas path. Ingestion of hot gases may be detrimental to a life of the engine components. Thus, there is room for improvement in the art.

BRIEF DESCRIPTION OF THE DRAWINGS

The invention is explained in the following description in view of the drawings that show.

DETAILED DESCRIPTION OF THE INVENTION

The present inventors have devised an aft outer rim seal arrangement (rim seal) that includes various flow guiding elements that prevent ingestion of hot gases into an outer cavity adjacent to the rim seal, and the rotor cavity inward of the outer cavity, and minimize a purge flow from the outer cavity and into the hot gas path. Minimizing the purge flow leaves more cooling fluid available for cooling the turbine blade. The various flow guiding elements can be used individually or together within the rim seal. The aft outer rim seal arrangement can be used for a turbine blade cooled with compressed air or a turbine blade cooled using an ambient air cooling arrangement. The description herein describes the aft outer rim seal arrangement as used in an ambient air cooled arrangement, but the technology can also be applied directly to a compressed air cooled arrangement.

Figure 1:
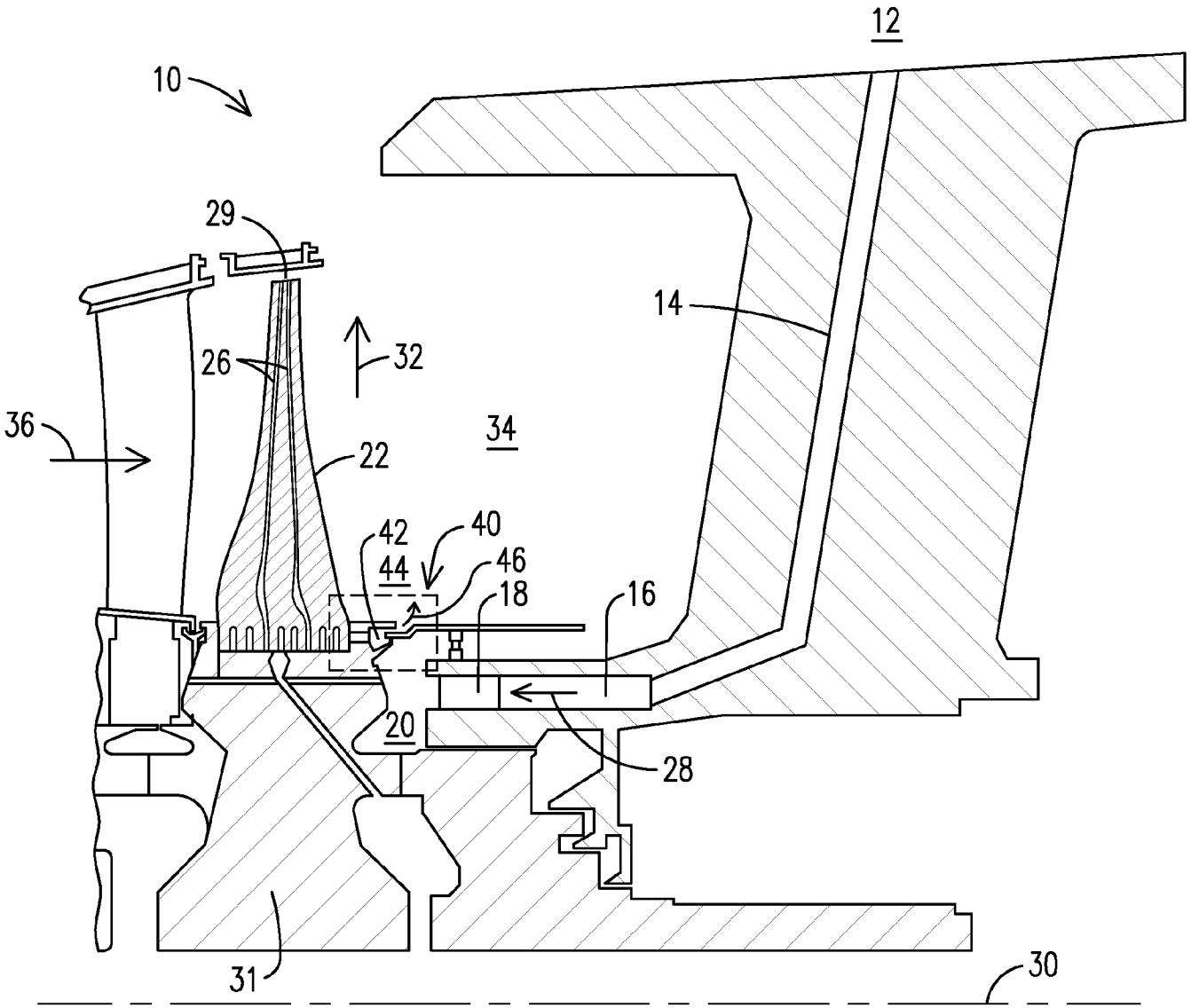
FIG. 1 is a schematic cross section of a side view of a portion of an induced air cooling circuit.

FIG. 1 shows a schematic cross section of a side view of a portion of one configuration of an ambient air cooling circuit 10, including: a source 12 of ambient air; at least one air supply passage 14 between the source 12 and a pre-swirler plenum 16 and a pre-swirler 18; a rotor cavity 20 located adjacent to turbine blades 22; and a cooling channel inlet (not shown), a cooling channel 26 internal to the turbine blade 22, and a cooling channel outlet 29 in each of the turbine blades 22. Once inside the air supply passage 14 the ambient air becomes cooling fluid 28. The cooling fluid 28 travels through the air supply passage 14 where it enters the pre-swirler plenum 16, which is an annular shaped plenum and which is supplies the cooling fluid 28 to the pre-swirler 18. In the pre-swirler 18 the cooling fluid 28 is swirled about a longitudinal axis 30 of the rotor disc 31. The cooling fluid 28 enters the cooling channel inlets, for example, either directly from the pre-swirler 18 or after the cooling fluid 28 travels through a gap between a rotor disc 31 and a base of the turbine blade 22, and then the cooling fluid 28 travels through each cooling channel 26. When in the cooling channels 26 a rotation of the turbine blades 22 creates a centrifugal force in a direction 32 (radially outward) that motivates the cooling fluid 28 through the cooling channels 26. The cooling fluid 28 is ejected from the cooling channel outlet 29 and into a hot gas path 34 in which hot gases 36 flow. The movement of the cooling fluid 28 through the cooling channels 26 and out the cooling channel outlet 29 creates a suction force that draws cooling fluid 28 from the rotor cavity 20 into the cooling channel 26 to replace the cooling fluid 28 that has been ejected. A static pressure of ambient air pushes cooling fluid 28 toward the rotor cavity 20 to replace cooling fluid 28 that is drawn into the cooling channels 26, thereby completing the ambient air cooling circuit 10.

An aft outer rim seal arrangement 40 (rim seal) is disposed between an outer cavity 42 and a radially inward region 44 the hot gas path 34. During operation a static pressure $P_{rotorcavity}$ in the rotor cavity 20 and a static pressure $P_{outercavity}$ in the outer cavity 42 are slightly below a static pressure $P_{ambient}$ in the source 12 of the ambient air, and slightly above a static pressure $P_{inwardhotgases}$ of the hot gases 36 in the radially inward region 44 the hot gas path 34. A static pressure difference between $P_{outercavity}$ and $P_{inwardhotgases}$ is enough to drive a purge flow 46 out of the outer cavity 42 through the rim seal 40. However, this static pressure difference may not be large enough to overcome transient static pressure conditions during operation, and as a result it is possible for hot gases 36 to flow from the radially inward region 44 the hot gas path 34, back through the rim seal 40, and into the outer cavity 42 and possibly into the rotor cavity 20.

Figure 2:
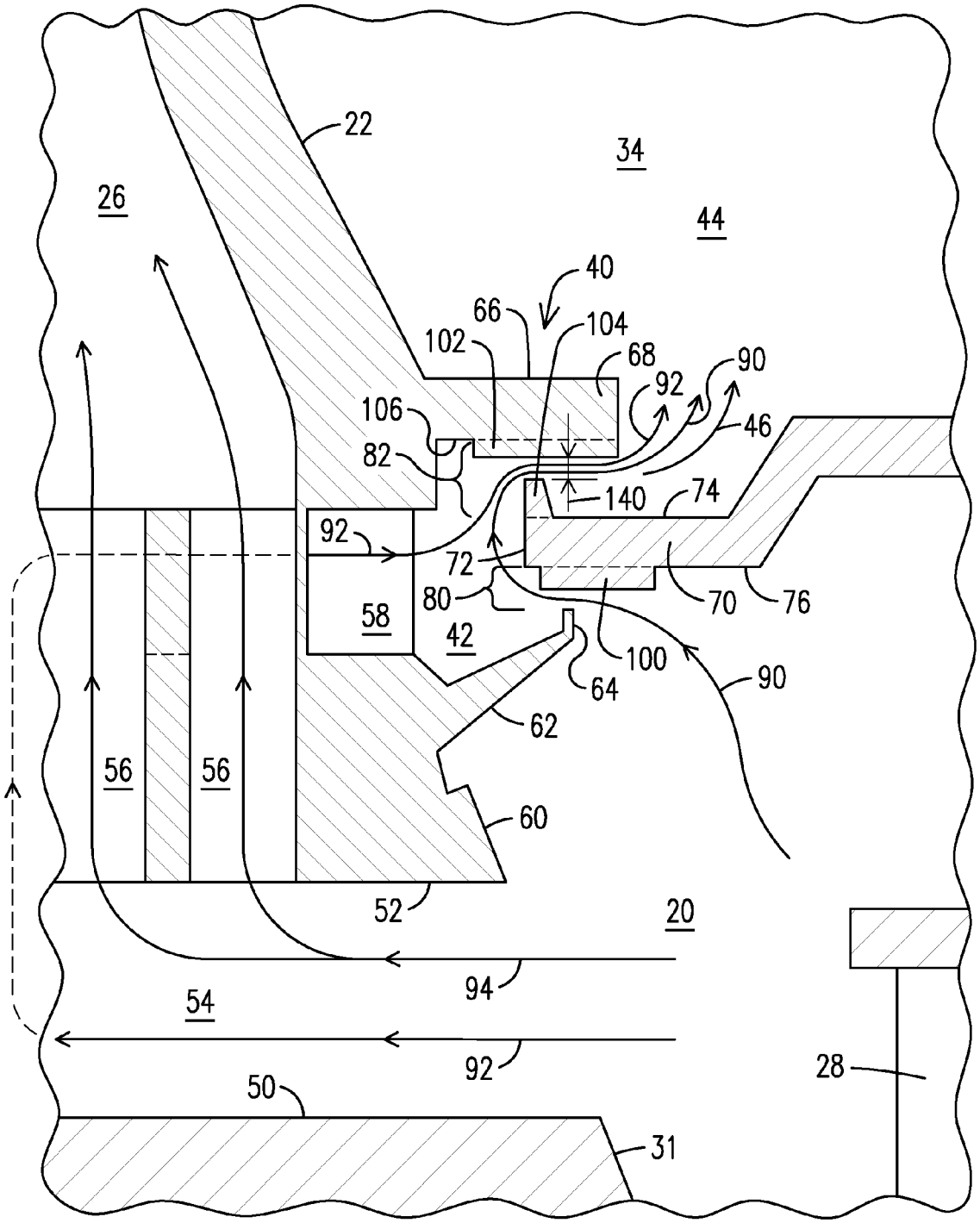
FIG. 2 is a schematic cross section of a side view of a portion of a rim seal in the induced air cooling circuit of FIG. 1.

FIG. 2 schematic cross section of a side view of an exemplary embodiment of the rim seal 40 of FIG. 1. The turbine blade 22 may be installed in the rotor disc 31 which, in an exemplary embodiment, may have be a dovetail slot to receive and secure a dovetail-shaped base of the turbine blade 22. Between a bottom 50 of the dovetail slot and a bottom 52 of a base of the turbine blade 22 there may be a dovetail gap 54 in fluid communication with both the rotor cavity 20 and with entry passages 56 between the dovetail gap 54 and the cooling channel 26. The gap 54 may also be in fluid communication with axially oriented "dead rim" cooling channels (not shown) between the rotor disc 31 and an inner surface of a blade platform (not shown), and circumferentially adjacent (i.e. in front of or behind when looking at the cross section, from left to right) to the entry passages 56. The dead rim cooling channels may lead to a dead rim cooling channel outlet 58 that opens to the outer cavity 42.

The turbine blade 22 may have an aft side 60, a lower angel wing 62 having a lower angel wing aft end 64, and an upper angel wing 66 having an upper angel wing aft end 68. The lower angel wing 62 and the upper angel wing 66 may surround a stationary rim 70 that is annular shaped and centered about the longitudinal axis 30 of the rotor disc 31. The stationary rim 70 may have a rim fore-end 72, a rim outward-facing surface 74, and a rim inward-facing surface 76. The rim seal 40 may then have two seal gaps: a lower angel wing seal gap 80 between and defined by the lower angel wing aft end 64 and the rim inward facing surface 76; and an upper angel wing seal gap 82 between and defined by the upper angel wing aft end 68 and the rim outward facing surface 74. In an exemplary embodiment the lower angel wing seal gap 80 may be approximately 9.0 mm, and the upper angel wing seal gap 82 may be approximately 4 mm.

In operation the static pressure $P_{inwardhotgases}$ of the hot gases 36 in the radially inward region 44 the hot gas path 34 is slightly lower than the static pressure $P_{ambient}$ in the source 12 of the ambient air, and this moves cooling fluid 28 from the source 12 of ambient air, through the air supply passage 14, and through the pre-swirler 18 where it is swirled about the longitudinal axis 30 of the rotor disc 31 as it enters the rotor cavity 20. Once in the rotor cavity 20 the lower static pressure $P_{inwardhotgases}$ of the hot gases 36 in the radially inward region 44 the hot gas path 34 may draw some of cooling fluid 28 along a first cooling fluid path 90 that is external to the turbine blade 22, from the rotor cavity 20, through the lower angel wing seal gap 80, into the outer cavity 42, and through the upper angel wing seal gap 82, where it exhausts into the hot gas path 34. Some of the cooling fluid 28 may be drawn along a second cooling fluid path 92 from the rotor cavity 20, through the dovetail gap 54, into the dead rim cooling channels (not shown) adjacent the entry passages 56, to the dead rim cooling channel outlet 58, to the outer cavity 42, and through the upper angel wing seal gap 82, where it exhausts into the hot gas path 34. Yet another portion of the cooling fluid 28 may be drawn along a third cooling fluid path 94 from the rotor cavity 20, through the dovetail gap 54, and into one of the entry passages 56 leading to the cooling channel 26, where it then exhausts into the hot gas path 34.

Hot gas ingestion into the third cooling fluid path 94 through the turbine blade 22 is less of a concern due to the rotation of the turbine blades 22 that mechanically introduces the necessary static pressures and centrifugal force to the cooling fluid 28 in the third cooling fluid path 94 to keep the hot gases 36 from entering. However, the transient static pressure variations in the hot gas path 34, and even the suction created in the third cooling fluid path 94 that leads to the rotor cavity 20, which, in turn, is in fluid communication with the outer cavity 42, could result in a situation where the static pressure $P_{rotorcavity}$ in the rotor cavity 20 and/or the static pressure $P_{outercavity}$ in the outer cavity 42 could drop below the static pressure $P_{inwardhotgases}$ of the hot gases 36 in the radially inward region 44 the hot gas path 34. This would invite ingestion of the hot gases 36 from the hot gas path 34. This reversal of flow in across the lower angel wing seal gap 80 and possibly the upper angel wing seal gap 82 may be a greater concern due to the reliance on the static pressure $P_{ambient}$ in the source 12 of the ambient air, and its relatively small driving force due to the relatively small static pressure difference between $P_{outercavity}$ and $P_{inwardhotgases}$.

The inventors have developed various flow guiding elements that are configured to prevent the ingestion of the hot gases 36 across the lower angel wing seal gap 80 and possibly the upper angel wing seal gap 82. The flow guiding elements include guide vanes 100, pumping fins 102, and a discourager tooth 104. In an exemplary embodiment the guide vanes 100 may be disposed on the rim inward facing surface 76, which is stationary, within the lower angel wing seal gap 80. The guide vanes 100 act similar to the pre-swirler 18 in that the guide vanes 100 impart swirl to cooling fluid 28 traversing the lower angel wing seal gap 80, which provides for a better match between the cooling fluid 28 traversing the lower angel wing seal gap 80 and the rotating turbine blades 22.

In an exemplary embodiment the pumping fins 102 may be disposed on a radially inward side 106 of the upper angel wing aft end 68 in the upper angel wing seal gap 82 and take advantage of the existing rotation of the turbine blades 22 to generate a pumping action on the cooling fluid 28 present in the outer cavity 42. This pumping action pumps the cooling fluid 28 through the upper angel wing seal gap 82, and this reduces the chances of ingestion of the hot gases 36. A discourager tooth 104 may be disposed anywhere a large enough gap remains. In an exemplary embodiment, the discourager tooth 104 may be disposed on the rim outward facing surface 74 and toward the rim fore-end 72, also in the upper angel wing seal gap 82 adjacent the pumping fins 102. This discourager tooth 104 presents a physical barrier to hot gases 36 present in the radially inward region 44 of the hot gas path 34, which would mitigate ingestion. The discourager tooth 104 also presents the same physical barrier to cooling fluid 28 present in the outer cavity 42. As a result less cooling fluid 28 may be lost as purge flow 46 while chances of ingestion of the hot gases 36 are also reduced.

Figure 3:
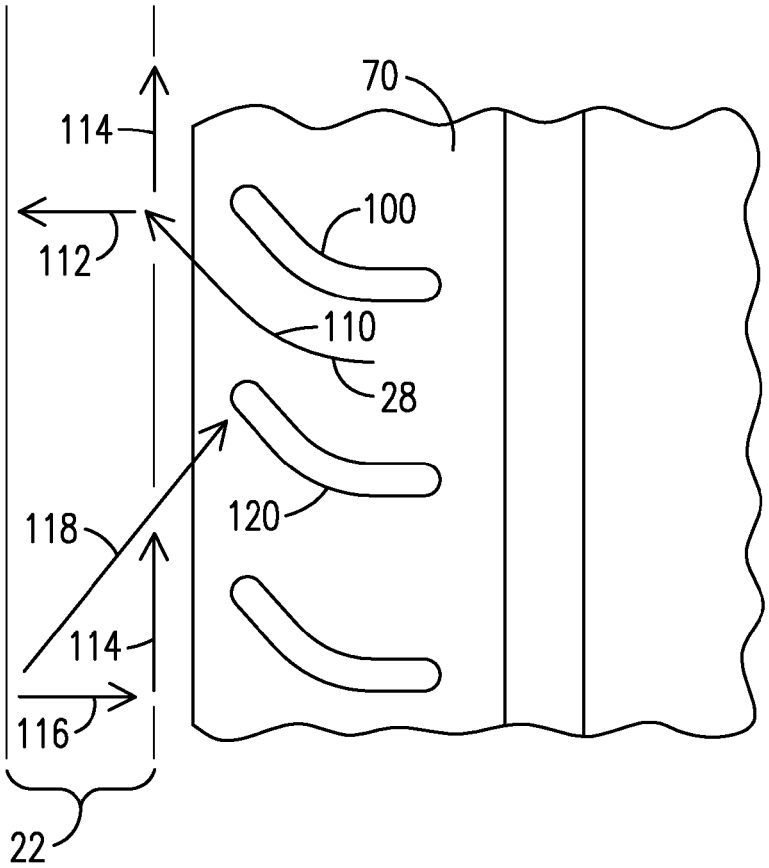
FIG. 3 is a view of guide vanes of the rim seal of FIG. 2.

FIG. 3 shows the guide vanes 100 of the rim seal 40 of FIG. 2, looking radially inward through the stationary rim 70. As cooling fluid 28 traverses the a lower angel wing seal gap 80 a swirl is imparted such that a swirled direction 110 of flow includes an axial forward direction 112 and a circumferential direction 114, where the turbine blades 22 (indicated generally) are rotating in the circumferential direction 114. Hot gases 36 may also be rotating in the hot gas path 34 in the same circumferential direction 114 prior to ingestion. After ingestion the hot gases 36 may be motivated to move in the circumferential direction 114 because the hot gases 36 would be entering the swirling cooling fluid 28 and friction may impart the circumferential motion. However, to be ingested the hot gases 36 would need to travel in an opposite, axially rearward direction 116. When moving in axially rearward direction 116 and circumferential direction 114, the hot gases 36 would then be traveling in an ingested direction 118. Ingested direction 118 may encounter a convex side 120 of the guide vane 100 and the convex side 120 may act as a physical barrier to the hot gases 36, thereby reducing ingestion. In certain instances the convex side 120 may deflect the hot gases 36 back toward the outer cavity 42, further reducing ingestion. In an exemplary embodiment the guide vanes 100 may extend approximately 2.5 mm into the lower angel wing seal gap 80.

Figure 4:
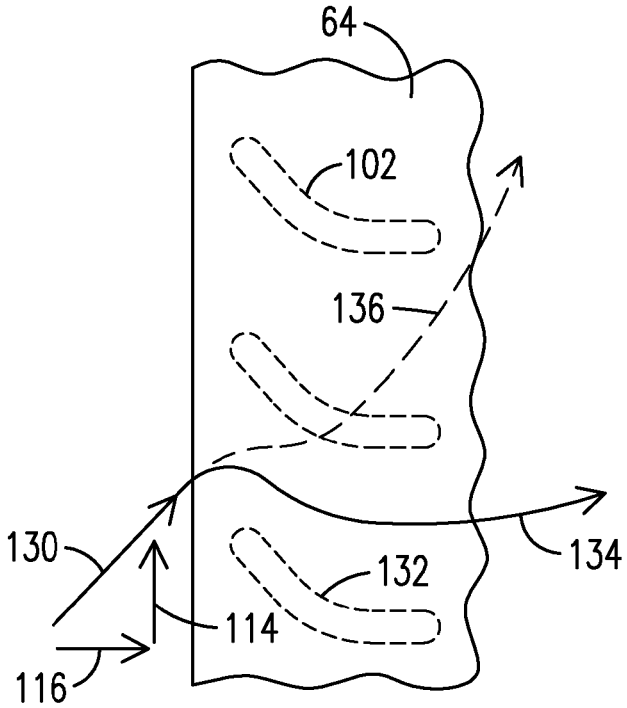
FIG. 4 is a view of pumping fins of the rim seal of FIG. 2.

FIG. 4 shows the pumping fins 102 of the rim seal 40 of FIG. 2, looking radially inward through the upper angel wing 66. Cooling fluid enters the outer cavity 42 either through the lower angel wing seal gap 80, where it is swirled, or via the dead rim cooling channel outlet 58, which is rotating with the turbine blade 22. Thus, in both cases the cooling fluid 28 in the outer cavity 42 is swirling. Since it must change axial direction in order to exit via the upper angel wing seal gap 82, the cooling fluid 28 in the outer cavity 42 will be flowing in purge flow direction 130, which includes the circumferential direction 114 and the axially rearward direction 116. The pumping fins 102 are rotating with the turbine blades 22 in the circumferential direction 114 as well. Thus, the pumping fins 102 may be angled as shown in order to scoop/draw the cooling fluid 28 in the outer cavity 42 and use a concave side 132 of the pumping fin 102 as an impeller to drive the cooling fluid in the axially rearward direction 116, and in the circumferential direction 114. As the cooling fluid 28 traverses the pumping fins 102 it may take a relative purge flow path 134 with respect to the pumping fins 102. However, since the pumping fins 102 are rotating in the circumferential direction 114, the cooling fluid 28 would follow an absolute purge flow path 136. Any hot gases 36 attempting to enter through the lower angel wing seal gap 80 would similarly encounter the concave side 132 of the pumping fin 102 which would resist/deter the oncoming flow of hot gases 36. A speed of rotation of the turbine blades 22 that is faster than the circumferential movement of the hot gases 36 and the cooling fluid 28 in the outer cavity 42 enable this pumping action.

The pumping action of the pumping fins 102 would create a second suction on the cooling fluid 28, in addition to that created by the rotation of the turbine blades 22. This would help draw some cooling fluid 28 through the outer cavity 42. This, in turn, would help draw cooling fluid 28 through the dead rim cooling channels, which might otherwise tend to stagnate. This would result in a greater portion of the purge flow 46 coming directly from the rotor cavity 20, as opposed to coming both directly from the rotor cavity 20 and via the dead rim cooling channels. Thus, the pumping fins 102 not only resist ingestion, they encourage flow through the dead rim cooling channels. In an exemplary embodiment the pumping fins 102 may extend approximately 2.0 mm into the upper angel wing seal gap 82.

When the pumping fins are used in conjunction with the discourager tooth 104, the upper angel wing seal gap is reduced in size to a toothed upper angel wing seal gap 140. This reduction in size provides a smaller opening which is more difficult for ingested gases to traverse. It further reduces a total volume of the purge flow 46, thereby leaving more cooling fluid 28 for the turbine blade 22. In an exemplary embodiment the discourager tooth 104 may extend approximately 4.5 mm into the upper angel wing seal gap 82.

From the foregoing, it has been shown that the present inventors have developed various flow guiding elements that prevent ingestion of hot gases through the rim seal. These flow guiding elements can be used by themselves, or together as part of an outer rim seal arrangement. The flow guiding elements are simple to manufacture, yet effective in helping to prevent ingestion of hot gases that shorten a service life of the engine components. As a result, the outer rim seal arrangement disclosed herein represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An outer rim seal arrangement for a gas turbine engine, comprising:

an annular and stationary rim centered about a longitudinal axis of a rotor disc, extending fore and comprising a fore-end, a radially outward-facing surface, and a radially inward-facing surface;

a lower angel wing extending aft from a base of a turbine blade and comprising an aft end disposed radially inward of the rim inward-facing surface to define a lower angel wing seal gap between a rotor cavity and an outer cavity;

an upper angel wing extending aft from the base of the turbine blade and comprising an aft end disposed radially outward of the rim outward-facing surface to define an upper angel wing seal gap between the outer cavity and a hot gas path;

guide vanes disposed on the rim inward-facing surface in the lower angel wing seal gap and configured to discourage flow through the lower angel wing seal gap and into the rotor cavity during operation of the gas turbine engine, an air supply passage providing fluid communication between the rotor cavity and a source of a cooling fluid at atmospheric pressure, and a preswirler disposed downstream of the blade, between the air supply passage and the rotor cavity, wherein when the blade is rotating during operation the rotation is effective to draw the cooling fluid from the source, through the air supply passage, and into the rotor cavity.

2. The outer rim seal arrangement of claim 1, wherein the guide vanes impart swirl about the rotor disc longitudinal axis to a flow of cooling fluid flowing from the rotor cavity and into the outer cavity.

3. The outer rim seal arrangement of claim 1, further comprising pumping fins disposed on the upper angel wing seal aft end in the upper angel wing seal gap and configured to encourage a flow of cooling fluid from the outer cavity and into the hot gas path.

4. The outer rim seal arrangement of claim 3, further comprising a discourager tooth disposed on the rim fore-end and in the upper angel wing seal gap, the discourager tooth effective to discourage flow from the hot gas path and into the outer cavity.

5. The outer rim seal arrangement of claim 1, further comprising a discourager tooth disposed on the rim fore-end in the upper angel wing seal gap, the discourager tooth effective to discourage flow from the hot gas path and into the outer cavity.

6. An outer rim seal arrangement for a gas turbine engine, comprising:

a last stage turbine blade disposed on a rotor disc, in a hot gas path, downstream of other turbine blades, and comprising an internal cooling passage;

an annular and stationary rim centered about a longitudinal axis of the rotor disc comprising a fore-end adjacent an aft side of a base of the turbine blade, an radially outward-facing surface, and an radially inward-facing surface;

a lower angel wing extending aft from the turbine blade base and comprising an aft end disposed radially inward of the rim inward-facing surface to define a lower angel wing seal gap between an outer cavity and a rotor cavity;

an upper angel wing extending aft from the turbine blade base and comprising an aft end disposed radially outward of the rim outward-facing surface to define an upper angel wing seal gap between the hot gas path and the outer cavity;

flow guiding elements in at least one of the lower angel wing seal gap and the upper angel wing seal gap effective to preventingestion of hot gas into the outer cavity or the rotor cavity, and an air supply passage providing fluid communication between the rotor cavity and a source of a cooling fluid at atmospheric pressure, wherein when the blade is rotating during operation the rotation reduces a static pressure in the rotor cavity to below the atmospheric pressure, effective to draw the cooling fluid through the air supply passage.

7. The outer rim seal arrangement of claim 6, wherein the flow guiding elements comprise guide vanes disposed on the rim inward-facing surface in the lower angel wing seal gap, wherein the guide vanes impart swirl about the rotor disc longitudinal axis to a flow of cooling fluid flowing from the rotor cavity and into the outer cavity.

8. The outer rim seal arrangement of claim 6, wherein the flow guiding elements comprise pumping fins disposed on the upper angel wing seal aft end in the upper angel wing seal gap and configured to encourage a flow of cooling fluid from the outer cavity and into the hot gas path.

9. The outer rim seal arrangement of claim 6, further comprising a discourager tooth disposed on the rim fore-end and in the upper angel wing seal gap.

10. The outer rim seal arrangement of claim 6, wherein the flow guiding elements comprise:

guide vanes disposed on the rim inward-facing surface in the lower angel wing seal gap, wherein the guide vanes impart swirl about the rotor disc longitudinal axis to a flow of cooling fluid flowing from the rotor cavity and into the outer cavity; and pumping fins disposed on the upper angel wing seal aft end in the upper angel wing seal gap and configured to encourage a flow of cooling fluid from the outer cavity and into the hot gas path, and wherein the outer rim seal arrangement further comprises a discourager tooth disposed on the rim fore-end and in the upper angel wing seal gap.

11. An outer rim seal arrangement for a gas turbine engine, comprising:

a turbine blade disposed on a rotor disc, in a hot gas path, and comprising an internal cooling passage, wherein when rotating during operation the rotation is effective to motivate a cooling fluid through the internal cooling passage;

a first cooling fluid path external to the turbine blade and from a rotor cavity, the first cooling path extending through a lower angel wing seal gap on an aft side of the turbine blade, an outer cavity, an upper angel wing seal gap on the aft side of the turbine blade, and leading to the hot gas path;

a second cooling fluid path from the rotor cavity, said second cooling path extending through a portion of the internal cooling passage, into the outer cavity, through the upper angel wing seal gap, and leading to the hot gas path;

an air supply passage providing fluid communication between the rotor cavity and a source of the cooling fluid at atmospheric pressure; and a flow guiding element in at least one of the lower angel wing seal gap and the upper angel wing seal gap effective to discourage ingestion of hot gas from the hot gas path, wherein when the blade is rotating during operation the rotation reduces a static pressure in the rotor cavity to below the atmospheric pressure, effective to draw the cooling fluid through the air supply passage.

12. The outer rim seal arrangement of claim 11, wherein the flow guiding element comprises pumping fins disposed on an upper angel wing seal aft end in the upper angel wing seal gap and configured to encourage a flow of cooling fluid in the first cooling fluid path flow and a flow of cooling fluid in the second cooling fluid path.

13. The outer rim seal arrangement of claim 11, wherein the flow guiding element comprises guide vanes disposed on a stationary rim radially inward-facing surface in the lower angel wing seal gap, wherein the guide vanes impart swirl about a longitudinal axis of the rotor disc to a flow of cooling fluid flowing from the rotor cavity and into the outer cavity.

14. The outer rim seal arrangement of claim 13, wherein the guide vanes are oriented to present a convex side of the guide vane across a flow direction of ingested gases.

15. The outer rim seal arrangement of claim 11, wherein the flow guiding element comprises a discourager tooth disposed on a stationary rim fore-end and in the upper angel wing seal gap.

16. The outer rim seal arrangement of claim 11, wherein the flow guiding element comprises:

pumping fins disposed on an upper angel wing seal aft end in the upper angel wing seal gap and configured to encourage a flow of cooling fluid in the first cooling fluid path and a flow of cooling fluid in the second cooling fluid path;

guide vanes disposed on a stationary rim radially inward-facing surface in the lower angel wing seal gap, wherein the guide vanes impart swirl about a longitudinal axis of the rotor disc to a flow of cooling fluid flowing from the rotor cavity and into the outer cavity; and a discourager tooth disposed on a stationary rim fore-end and in the upper angel wing seal gap.

17. The outer rim seal arrangement of claim 1, wherein the blade is a last stage blade of a series of blades in a turbine.

18. The outer rim seal arrangement of claim 11, further comprising a preswirler disposed between the air supply passage and the rotor cavity.

19. The outer rim seal arrangement of claim 11, wherein the blade is a last stage blade in a series of blades in a turbine.

20. The outer rim seal arrangement of claim 11, further comprising a preswirler disposed downstream of the blade, between the air supply passage and the rotor cavity.

* * * * *